US009033048B2

(12) United States Patent
Judge

(10) Patent No.: US 9,033,048 B2
(45) Date of Patent: May 19, 2015

(54) APPARATUSES AND METHODS FOR DETERMINING WELLBORE INFLUX CONDITION USING QUALITATIVE INDICATIONS

(75) Inventor: Robert Arnold Judge, Houston, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 0 days.

(21) Appl. No.: 13/338,542

(22) Filed: Dec. 28, 2011

(65) Prior Publication Data

US 2013/0168100 A1 Jul. 4, 2013

(51) Int. Cl.

| | |
|---|---|
| ***E21B 33/076*** | (2006.01) |
| ***E21B 41/10*** | (2006.01) |
| ***E21B 7/12*** | (2006.01) |
| ***E21B 34/04*** | (2006.01) |
| ***E21B 49/10*** | (2006.01) |
| ***E21B 47/024*** | (2006.01) |
| ***E21B 47/01*** | (2012.01) |
| ***E21B 21/08*** | (2006.01) |
| *E21B 47/10* | (2012.01) |
| *E21B 47/12* | (2012.01) |
| *E21B 47/00* | (2012.01) |

(52) U.S. Cl.

CPC ..... *E21B 21/08* (2013.01); *E21B 47/1025* (2013.01); *E21B 47/12* (2013.01); *E21B 47/00* (2013.01); *E21B 47/10* (2013.01)

(58) Field of Classification Search

USPC ..... 166/336, 351, 352, 358, 363, 250.01, 166/264, 66; 175/24, 40, 48, 5; 340/853.1, 340/856.3; 702/9, 12

See application file for complete search history.

(56) References Cited

U.S. PATENT DOCUMENTS 3,550,697 A * 12/1970 Hobhouse ..... 175/26
3,595,075 A * 7/1971 Dower ..... 73/152.19

(Continued)

FOREIGN PATENT DOCUMENTS

| | | | |
|---|---|---|---|
| RU | 2435026 | C1 | 11/2011 |
| SU | 887803 | A | 12/1981 |
| WO | 2006118920 | A2 | 11/2006 |

OTHER PUBLICATIONS

U.S. Appl. No. 13/050,164, filed Mar. 17, 2011, entitled "Mudline Managed Pressure Drilling and Enhanced Influx Detection."

(Continued)

*Primary Examiner* — Matthew Buck
*Assistant Examiner* — Edwin Toledo-Duran
(74) *Attorney, Agent, or Firm* — Bracewell & Giuliani LLP

(57) ABSTRACT

Apparatuses and methods useable in drilling installations having a mud loop for detecting ongoing or imminent kick events are provided. An apparatus includes a first sensor configured to measure a input mud flow pumped into the well, and a second sensor configured to measure a variation of a return mud flow emerging from the well. The apparatus further includes a controller connected to the first sensor, and to the second sensor. The controller is configured to identify an ongoing or imminent kick event based on monitoring and comparing an evolution of the input mud flow as measured by the first sensor and an evolution of the return mud flow as inferred based on measurements received from the second sensor. Additionally, a third sensor can be included in the apparatus to confirm the conclusion made by the controller before alerting the user that a kick has likely occurred.

27 Claims, 4 Drawing Sheets

(56) References Cited

U.S. PATENT DOCUMENTS

| | | | | | |
|---|---|---|---|---|---|
| 3,646,808 | A * | 3/1972 | Leonard | 73/152.19 |
| 3,740,739 | A * | 6/1973 | Griffin et al. | 367/83 |
| 3,760,891 | A * | 9/1973 | Gadbois | 73/152.21 |
| 3,790,930 | A * | 2/1974 | Lamel et al. | 367/82 |
| 3,809,170 | A * | 5/1974 | Ilfrey et al. | 175/7 |
| 3,955,411 | A * | 5/1976 | Lawson, Jr. | 73/152.22 |
| 3,976,148 | A * | 8/1976 | Maus et al. | 175/7 |
| 3,994,166 | A * | 11/1976 | Dower | 73/861.47 |
| 4,091,881 | A * | 5/1978 | Maus | 175/7 |
| 4,208,906 | A * | 6/1980 | Roberts, Jr. | 73/152.32 |
| 4,224,988 | A * | 9/1980 | Gibson et al. | 166/250.01 |
| 4,250,974 | A * | 2/1981 | Heilhecker et al. | 175/48 |
| 4,282,939 | A * | 8/1981 | Maus et al. | 175/7 |
| 4,440,239 | A * | 4/1984 | Evans | 175/5 |
| 4,520,665 | A * | 6/1985 | Cordier et al. | 73/152.19 |
| 4,527,425 | A * | 7/1985 | Stockton | 73/152.21 |
| 4,553,429 | A * | 11/1985 | Evans et al. | 73/152.21 |
| 4,562,560 | A * | 12/1985 | Kamp | 367/83 |
| 4,733,232 | A * | 3/1988 | Grosso | 367/82 |
| 4,733,233 | A * | 3/1988 | Grosso et al. | 367/82 |
| 4,813,495 | A * | 3/1989 | Leach | 175/6 |
| 4,867,254 | A * | 9/1989 | Gavignet | 175/48 |
| 5,006,845 | A * | 4/1991 | Calcar et al. | 367/81 |
| 5,055,837 | A * | 10/1991 | Abdallah et al. | 367/83 |
| 5,070,949 | A * | 12/1991 | Gavignet | 175/48 |
| 5,154,078 | A * | 10/1992 | Codazzi | 73/152.22 |
| 5,163,029 | A | 11/1992 | Bryant | |
| 5,168,932 | A * | 12/1992 | Worrall et al. | 166/336 |
| 5,205,165 | A * | 4/1993 | Jardine et al. | 73/152.21 |
| 5,214,251 | A * | 5/1993 | Orban et al. | 181/102 |
| 5,222,048 | A * | 6/1993 | Grosso et al. | 367/32 |
| 6,257,354 | B1 * | 7/2001 | Schrader et al. | 175/38 |
| 6,415,877 | B1 * | 7/2002 | Fincher et al. | 175/5 |
| 6,484,816 | B1 * | 11/2002 | Koederitz | 175/25 |
| 6,668,943 | B1 * | 12/2003 | Maus et al. | 175/5 |
| 6,820,702 | B2 * | 11/2004 | Niedermayr et al. | 175/57 |
| 7,011,155 | B2 * | 3/2006 | Meister et al. | 166/250.01 |
| 7,185,719 | B2 * | 3/2007 | van Riet | 175/66 |
| 7,228,902 | B2 * | 6/2007 | Oppelt | 166/250.02 |
| 7,270,185 | B2 * | 9/2007 | Fontana et al. | 166/358 |
| 7,278,496 | B2 * | 10/2007 | Leuchtenberg | 175/48 |
| 7,395,878 | B2 * | 7/2008 | Reitsma et al. | 175/38 |
| 7,497,266 | B2 * | 3/2009 | Fossli | 166/358 |
| 7,562,723 | B2 * | 7/2009 | Reitsma | 175/72 |
| 7,650,950 | B2 | 1/2010 | Leuchtenberg | |
| 7,770,663 | B2 * | 8/2010 | Mathiszik | 175/48 |
| 7,984,770 | B2 * | 7/2011 | Sehsah | 175/48 |
| 8,457,897 | B2 * | 6/2013 | Hehmeyer | 702/6 |
| 2001/0050185 | A1 * | 12/2001 | Calder et al. | 175/5 |
| 2002/0066597 | A1 * | 6/2002 | Schubert et al. | 175/38 |
| 2003/0127230 | A1 * | 7/2003 | von Eberstein, Jr. et al. | 166/337 |
| 2003/0168258 | A1 * | 9/2003 | Koederitz | 175/38 |
| 2004/0040746 | A1 * | 3/2004 | Niedermayr et al. | 175/38 |
| 2008/0066905 | A1 * | 3/2008 | Aivalis et al. | 166/250.01 |
| 2008/0105434 | A1 * | 5/2008 | Orbell et al. | 166/356 |
| 2008/0123470 | A1 * | 5/2008 | Cooper et al. | 367/83 |
| 2009/0025930 | A1 * | 1/2009 | Iblings et al. | 166/244.1 |
| 2010/0018715 | A1 * | 1/2010 | Orbell et al. | 166/337 |
| 2010/0071794 | A1 * | 3/2010 | Homan | 138/125 |
| 2010/0211423 | A1 * | 8/2010 | Hehmeyer | 705/7 |
| 2011/0042076 | A1 * | 2/2011 | Reitsma | 166/250.01 |
| 2012/0273218 | A1 * | 11/2012 | Orbell et al. | 166/358 |

OTHER PUBLICATIONS

Search Report from corresponding EA Application No. 201201642, dated Apr. 17, 2013.

EP Search Report dated Apr. 3, 2013 from corresponding EP Application No. 12197655.9.

* cited by examiner

APPARATUSES AND METHODS FOR DETERMINING WELLBORE INFLUX CONDITION USING QUALITATIVE INDICATIONS

BACKGROUND

1. Technical Field

Embodiments of the subject matter disclosed herein generally relate to methods and apparatuses useable in drilling installations for determining a wellbore influx condition using qualitative indications.

2. Discussion of the Background

During drilling operations, gas, oil or other well fluids at a high pressure may flow from the drilled formations into the wellbore created during the drilling process. An unplanned influx from the formation into the wellbore is referred to in the industry as a "kick" and may occur at unpredictable moments. If the fluid influx is not promptly controlled, the well, the equipment in the well, and the drilling vessel is at risk. In order to protect the well and/or the equipment at risk, an assembly of valves called blow-out preventers, or BOPs, are located and actuated to contain the fluids in the wellbore upon detection of such events or indications of imminence of such events.

A traditional offshore oil and gas drilling configuration 10, as illustrated in FIG. 1, includes a platform 20 (or any other type of vessel at the water surface) connected via a riser 30 to a wellhead 40 on the seabed 50. It is noted that the elements illustrated in FIG. 1 are not drawn to scale and no dimensions should be inferred from relative sizes and distances illustrated in FIG. 1.

Inside the riser 30, as illustrated in the cross-section view A-A', there is a drill string 32 at the end of which a drill bit (not shown) may be rotated to extend the subsea well through layers below the seabed 50. Mud is circulated from a mud tank (not shown) on the drilling platform 20 inside the drill string 32 to the drill bit, and returned to the drilling platform 20 through an annular space 34 between the drill string 32 and a casing 36 of the riser 30. The mud maintains a hydrostatic pressure to counter-balancing the pressure of fluids in the formation being drilled and cools the drill bit while also transporting the cuttings generated in the drilling process to the surface. At the surface, the mud returning from the well is filtered to remove the cuttings, and re-circulated.

A blowout preventer (BOP) stack 60 is located close to the seabed 50. The BOP stack may include a lower BOP stack 62 attached to the wellhead 40, and a Lower Marine Riser Package ("LMRP") 64, which is attached to a distal end of the riser 30. During drilling, the lower BOP stack 62 and the LMRP 64 are connected.

A plurality of blowout preventers (BOPs) 66 located in the lower BOP stack 62 or in the LMRP 64 are in an open state during normal operation, but may be closed (i.e., switched in a close state) to interrupt a fluid flow through the riser 30 when a "kick" event occurs. Electrical cables and/or hydraulic lines 70 transport control signals from the drilling platform 20 to a controller 80 that is located on the BOP stack 60. The controller 80 controls the BOPs 66 to be in the open state or in the close state, according to signals received from the platform 20 via the electrical cables and/or hydraulic lines 70. The controller 80 also acquires and sends to the platform 20, information related to the current state (open or closed) of the BOPs. The term "controller" used here covers the well known configuration with two redundant pods.

Traditionally, as described, for example, in U.S. Pat. Nos. 7,395,878, 7,562,723, and 7,650,950 (the entire contents of which are incorporated by reference herein), a mud flow output from the well is measured at the surface of the water. The mud flow and/or density input into the well may be adjusted to maintain a pressure at the bottom of the well within a targeted range or around a desired value, or to compensate for kicks and fluid losses.

The volume and complexity of conventional equipment employed in the mud flow control are a challenge in particular due to the reduced space on a platform of an offshore oil and gas installation.

Another problem with the existing methods and devices is the relative long time (e.g., tens of minutes) between a moment when a disturbance of the mud flow occurs at the bottom of the well and when a change of the mud flow is measured at the surface. Even if information indicating a potential disturbance of the mud flow is received from the controller 80 faster, a relatively long time passes between when an input mud flow is changed and when this change has a counter-balancing impact at the bottom of the well.

Operators of oil and gas installations try to maintain an equivalent circulating density (ECD) at the bottom of a well close to a set value. The ECD is a parameter incorporating both the static pressure and the dynamic pressure. The static pressure depends on the weight of the fluid column above the measurement point, and, thus, of the density of the mud therein. The density of the mud input into the well via the drill string 32 may be altered by crushed rock or by fluid and gas emerging from the well. The dynamic pressure depends on the flow of fluid. Control of the mud flow may compensate for the variation of mud density due to these causes. U.S. Pat. No. 7,270,185 (the entire content of which is incorporated by reference herein) discloses methods and apparatuses operating on the return mud path, below the water surface, to partially divert or discharge the mud returning to the surface when the ECD departs from a set value.

U.S. patent application Ser. No. 13/050,164 proposes a solution of these problems in which a parameter proportional with a mud flow emerging from the wellbore is measured and used for controlling the outflow. However, accurately assessing the emerging mud flow is a challenge in itself because, unlike the mud pumped into the well, the emerging mud may not have a uniform composition. The emerging mud may sometimes (not always) contain formation cuttings or gas. This lack of uniformity in the mud composition affects the density or a mass balance. Additionally the drill string may be moving eccentrically inside the casing affecting measurement of the parameter proportional with the emerging mud flow. The mud may not be conductive enough to use magnetic parameters. Accurate ultrasonic parameter measurement may be impeded by mud's viscosity.

Accordingly, it would be desirable to provide methods and devices useable in offshore drilling installations near the actual wellhead for early detection of kick events or detecting indications of an imminence of a kick event, thereby overcoming the afore-described problems and drawbacks.

SUMMARY

Some embodiments set forth herewith detect imminent or ongoing kicks by monitoring the evolution (i.e., a sequence of values corresponding to successive moments) of the mud flow into the well versus the evolution of the mud flow coming out of the well. An accurate measurement of the return mud flow is not necessary or sought, instead using qualitative indications of variation of the return mud flow. Thus, the embodiments overcome the difficulty of achieving an exact measurement of the return mud flow and the delay of measuring the return mud flow at the surface.

According to one exemplary embodiment, an apparatus useable in an offshore drilling installation having a mud loop into a well drilled below the seabed is provided. The apparatus includes a first sensor configured to measure a input mud flow pumped into the well, and a second sensor configured to measure a variation of a return mud flow emerging from the well. The apparatus further includes a controller connected to the first sensor, and to the second sensor. The controller is configured to identify an ongoing or imminent kick event based on monitoring and comparing an evolution of the input mud flow as measured by the first sensor and an evolution of the return mud flow as inferred based on measurements received from the second sensor.

According to another embodiment, a method of manufacturing an offshore drilling installation is provided. The method includes providing a first sensor configured to measure a input mud flow pumped into the well, and a second sensor configured to measure a variation of a return mud flow emerging from the well. The method further includes connecting a controller to the first sensor and to the second sensor, the controller being configured to identify an ongoing or imminent kick event based on monitoring comparatively an evolution of the input mud flow as measured by the first sensor and an evolution of the return mud flow as inferred based on measurements received from the second sensor.

According to another embodiment, a method of identifying an ongoing or imminent kick event in an offshore drilling installation having a mud loop into a well drilled below the seabed is provided. The method includes receiving) measurements from a first sensor configured to measure an input mud flow pumped into the well and a second sensor configured to measure a variation of a return mud flow emerging from the well. The method further includes, based on the received measurements, monitoring and comparing an evolution of the input mud flow and an inferred evolution of for the return mud flow, to identify the ongoing or imminent kick event. The ongoing or imminent kick is identified (1) when the return mud flow increases while the input mud flow pumped into the well is substantially constant, or (2) when the return mud flow remains substantially constant or increases while the input mud flow pumped into the well decreases. The identification of the kick event takes into consideration a delay between a normal increase or decrease of the input mud flow pumped into the well and the variation of the return mud flow caused by the normal increase or decrease of the input mud flow pumped into the well.

A final embodiment includes the previously mentioned embodiments and adds another sensor (pressure, temperature, density, etc.) but that is NOT a flow measurement that can be used as a confirming indicator that an influx has occurred. The controller would take the input from the flow sensors, discern that a kick is occurring from flow measurements, and then poll the additional sensor to confirm that an event has occurred.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a drilling installation having a mud loop. However, the embodiments to be discussed next are not limited to these systems, but may be applied to other systems that require monitoring a fluid flow at a location far from the fluid source.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
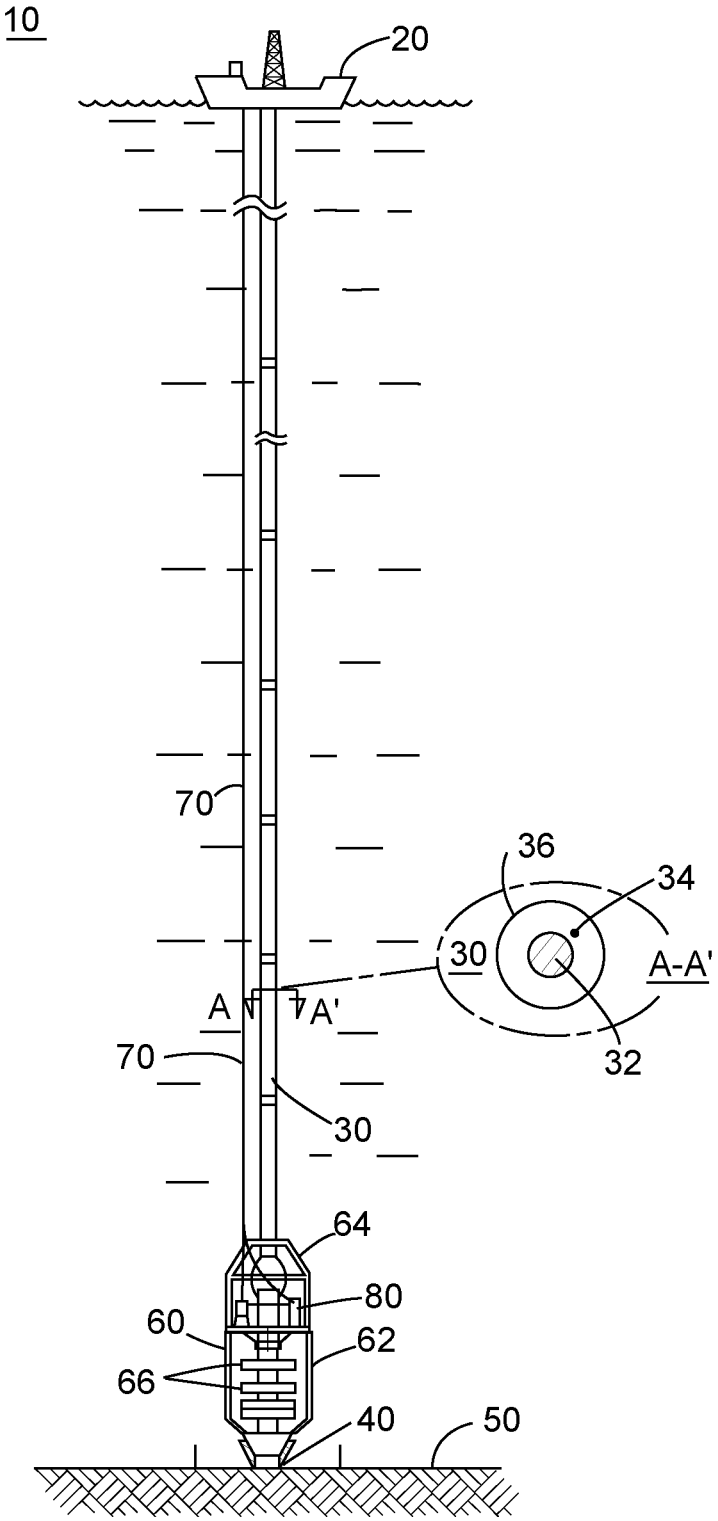
Figure 1 (Background Art)
FIG. 1 is a schematic diagram of a conventional offshore rig.
Figure 2:
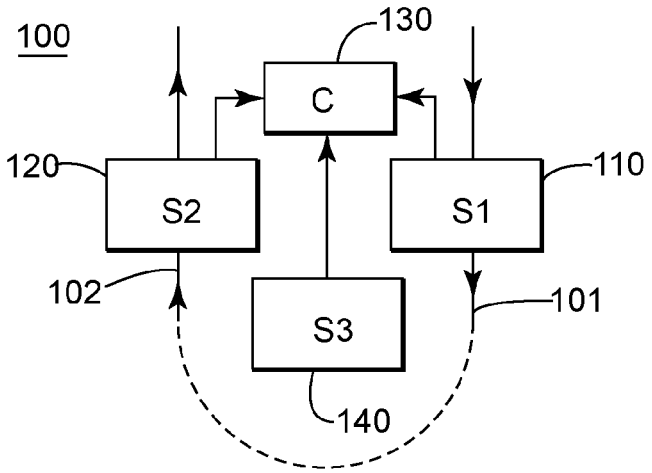
FIG. 2 is a schematic diagram of an apparatus, according to an exemplary embodiment.

FIG. 2 is a schematic diagram of an exemplary embodiment of an apparatus 100 useable in an offshore drilling installation having a mud loop. The apparatus 100 is useable in an offshore drilling installation having a mud loop into a well drilled below the seabed. A fluid (named "mud") flow is pumped into the well, for example, from a platform on the water surface, and flows towards the well via an input fluid path 101 (e.g., the drill string 32). A return mud flow flows from the well towards the surface (e.g., vessel 20) via a return path 102 (e.g., the annular space 34 between the drill string 32 and the casing 36).

The apparatus 100 includes a first sensor 110 configured to measure the input mud flow pumped into the well. The first sensor 110 may be a stroke counter connected to a fluid pump (not shown) that provides the input mud flow into the input fluid path 101. Due to the uniformity of the density and other physical properties of the mud input into the well, various known flow measuring methods may be employed. The input flow measurement may be performed at the surface.

The apparatus 100 further includes a second sensor 120 configured to detect a variation of the return mud flow. In other words, accuracy of a flow measurement is not required for the second sensor. The second sensor 120 is preferably configured to detect the variation of the return mud flow near the seabed in order to avoid delays due to the time necessary for the return mud flow to travel to a detection site, towards the surface. In an exemplary embodiment, the second sensor may be a flow measuring device. In another exemplary embodiment, the second sensor may be a pressure sensor. In another exemplary embodiment, the second sensor may be an electromagnetic sensor monitoring impedance of the return mud flow or an acoustic sensor monitoring acoustic impedance of the return mud flow. The second sensor may be a combination of sensors which, while none by itself can provide a reliable basis for estimating the return mud flow, but when sensor indications are combined according to predetermined rules, they may provide a measurement indicating a variation of the return mud flow rate.

The apparatus 100 further includes a controller 130 connected to the first sensor 110, and to the second sensor 120. The controller 130 is configured to identify an ongoing or imminent kick event based on monitoring and comparing the evolution of the input mud flow as measured by the first sensor and the evolution of the return mud flow as inferred based on measurements received from the second sensor. The controller 130 may be located close to the seabed (e.g., as part of the BOP stack 60). Alternatively, the controller 130 may be located at the surface (e.g., on the platform 20). The controller 130 may be configured to generate an alarm signal upon identifying the ongoing or imminent kick event. This alarm signal may trigger closing of the BOPs.

The apparatus 100 may further include a third sensor 140 connected to the controller 130 and configured to provide measurements related to the drilling, to the controller 130. The controller 130 may confirm that the ongoing or imminent kick event has occurred based on the measurements received from the third sensor 140, before generating the alarm signal alerting, for example, the operator (i.e., the user) that a kick has likely occurred. The third sensor 140 may (1) detect an acoustic event, or "sound" of the kick event, or (2) detect flow using a different technique than the second sensor, or (3) detect a density change in the fluid, or (4) detect a sudden temperature change due to the influx. The third sensor 140 could be located in the BOP or even in the drill string near the formation, provided there is a transmission method (wired drill pipe or pulse telemetry) to get the measurements from this third sensor to the controller 130.

Figure 3:
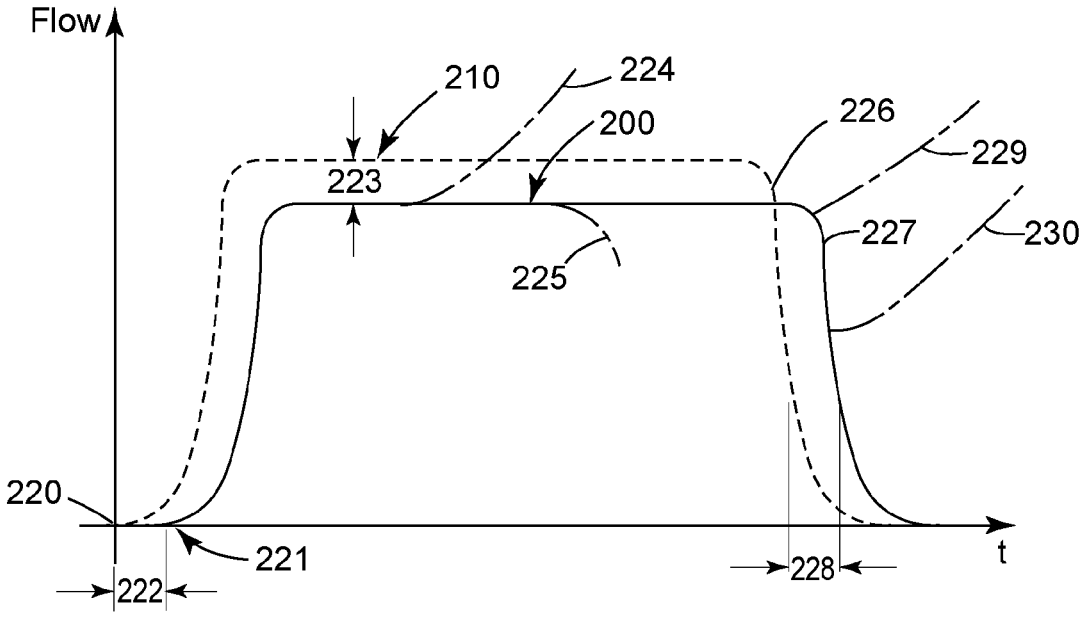
FIG. 3 is a graph illustrating the manner of operating of an apparatus, according to another exemplary embodiment.

FIG. 3 is a graph illustrating the manner of operating of an apparatus, according to an exemplary embodiment. The y-axis of the graph represents the flow in arbitrary units, and the x-axis of the graph represents time. The controller may receive measurements from the first sensor and from the second sensors at predetermined time intervals as fast as 100 milliseconds per sample. The time intervals for providing measurements to the controller may be different for the first sensor than for the second sensor. In determining whether individual values measured by the second sensor are fluctuations or part of a trend in the evolution of the return mud flow, predetermined thresholds (e.g., the predetermined number of measurements larger than a predetermined magnitude that indicate a trend) may be employed.

In the graph illustrated in FIG. 3, the full line 200 represents the return mud flow as detected by second sensor 120 and the dashed line 210 represents the input flow as detected by first sensor 110. Labels 220-230 marked on the graph in FIG. 3 are used to explain the manner of identifying an ongoing or imminent kick event based on monitoring and comparing the evolution of the input mud flow as measured by the first sensor 110 and the evolution of the return mud flow as inferred based on measurements received from the second sensor 120.

At 220, fluid starts being input into the well (e.g., mud pumps on the rig are powered and stroke counters start providing a measure of the input mud flow pumped towards the well). In response to this normal increase of the input mud flow at 220, the return mud flow starts increasing at 221. The interval between 221 and 222 represents a delay between the normal increase of the input mud flow pumped into the well and the variation (increase) of the return mud flow caused by this normal increase. The input flow increases until it reaches a nominal (operational) value. The output flow is estimated based on the detected variation thereof. The variation may be in fact a derivative of a measurement with relative low accuracy of the output flow. A difference 223 between the input flow and the output flow is not significant in itself but its evolution may be used for identifying an ongoing or imminent kick event.

If while the input flow remains constant, the output flow increases as illustrated by the curve labeled 224, the controller identifies that a kick event has occurred or is imminent. If while the input flow remains constant, the output flow decreases as illustrated by the curve labeled 225, the controller may identify that return circulation has been lost.

At 226, the input flow is cutoff (e.g., the mud pumps on the rig are powered off). In response to this normal decrease of the input mud flow, the return mud flow also starts decreasing at 227. The delay (lag) between the normal decrease of the input mud flow pumped into the well and the variation (decrease) of the return mud flow caused by this normal decrease labeled 228 is substantially the same as the delay labeled 222. If in spite of the decreasing input mud flow the return mud flow increases as illustrated by curves labeled 229 and 230, the controller identifies that a kick event has occurred (i.e., is ongoing) or is imminent.

Thus, the controller 130 monitors and compares the evolution of the input mud flow as measured by the first sensor and an evolution of the return mud flow as inferred (i.e., estimated) based on measurements received from the second sensor, in order to identify an ongoing or imminent kick event.

The controller 130 or/and the sensors may transmit measurements related to monitoring the input mud flow and the return mud flow to an operator interface located at the surface, so that an operator may visualize the evolution of the input flow and/or of the return mud flow.

Figure 4:
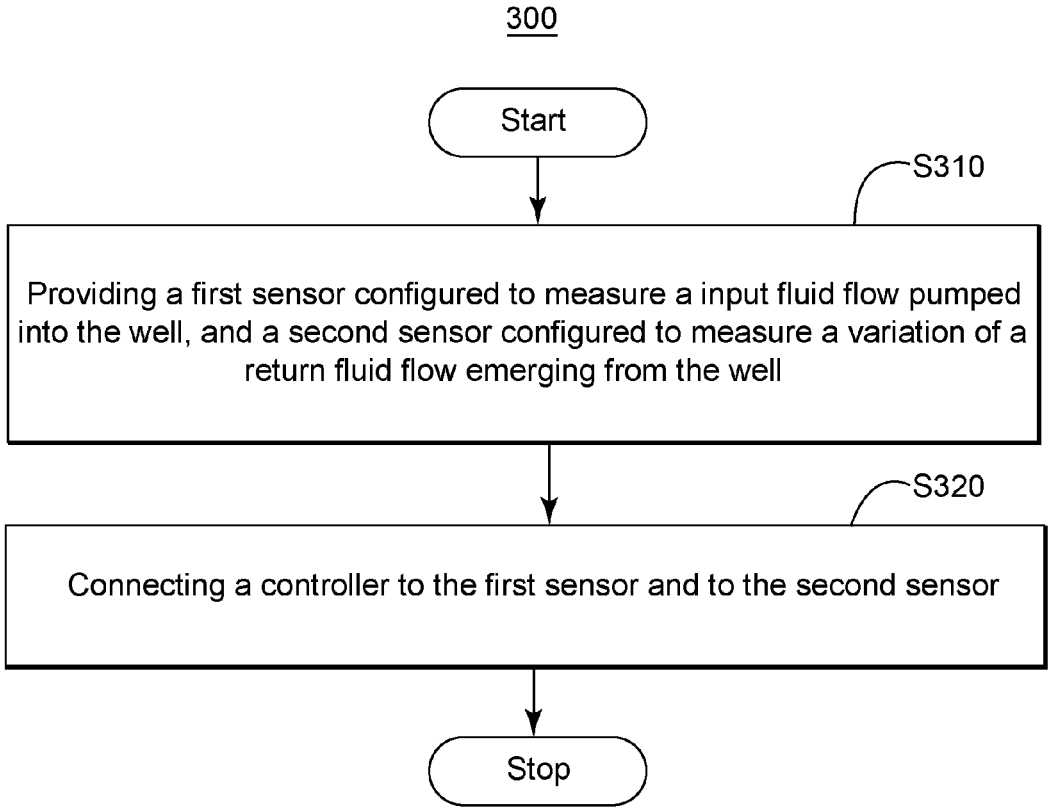
FIG. 4 is a flow diagram of a method of manufacturing an offshore drilling installation, according to an exemplary embodiment.

Any of the embodiments of the apparatus may be integrated into the offshore installations. A flow diagram of a method 300 for manufacturing an offshore drilling installation having a mud loop into a well drilled below the seabed, to be capable to detect a kick event without accurately measuring the return mud flow, is illustrated in FIG. 4. The method 300 includes providing a first sensor configured to measure a input mud flow pumped into the well, and a second sensor configured to measure a variation of a return mud flow emerging from the well, at S310. The method 300 further includes connecting a controller to the first sensor and to the second sensor, the controller being configured to identify an ongoing or imminent kick event based on monitoring comparatively an evolution of the input mud flow as measured by the first sensor and an evolution of the return mud flow as inferred based on measurements received from the second sensor, at S320.

In one embodiment, the method may also include connecting the controller to blowout preventers of the installation to trigger closing thereof upon receiving an alarm signal generated by the controller to indicate indentifying the ongoing or imminent kick event. In another embodiment, the method may further include connecting the controller to an operator interface located at the surface, to transmit measurements received from the first sensor and from the second sensor.

Figure 5:
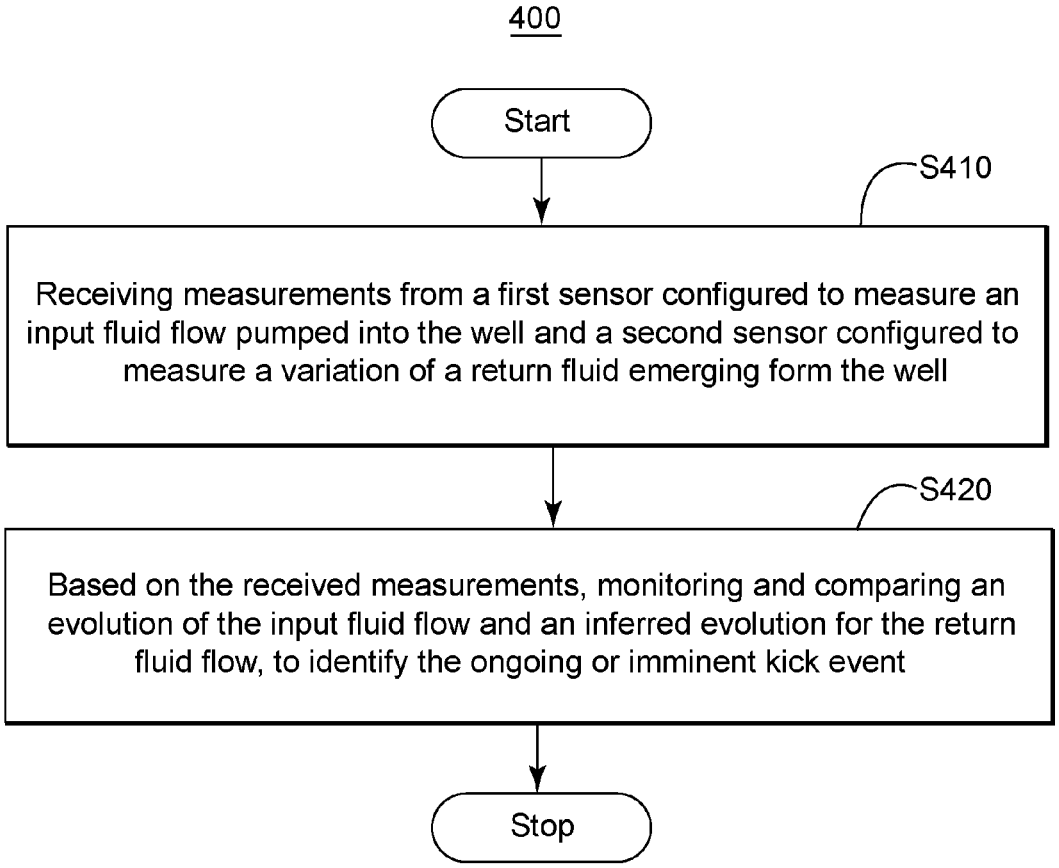
FIG. 5 is a flow diagram of a method of identifying an ongoing or imminent kick event in an offshore drilling installation having a mud loop into a well drilled below the seabed.

A flow diagram of a method 400 of identifying an ongoing or imminent kick event in an offshore drilling installation having a mud loop into a well drilled below the seabed is illustrated in FIG. 5. The method 400 includes receiving measurements from a first sensor configured to measure an input mud flow pumped into the well and from a second sensor configured to measure a variation of a return mud flow emerging from the well, at S410. The method 400 also includes, based on the received measurements, monitoring and comparing the evolution of the input mud flow and the inferred evolution of the return mud flow, to identify the ongoing or imminent kick event, at S420. The ongoing or imminent kick event occurs (1) when the return mud flow increases while the input mud flow pumped into the well is substantially constant, or (2) when the return mud flow remains substantially constant or increases while the input mud flow pumped into the well decreases. The comparison takes into consideration the inherent delay between a normal increase or decrease of the input mud flow pumped into the well and the variation of the return mud flow caused by the normal increase or decrease of the input mud flow pumped into the well.

In one embodiment, the method may further include generating an alarm signal upon identifying the ongoing or imminent kick event. In another embodiment, the method may further include transmitting the measurements received from the first sensor and from the second sensor to an operator interface located at the surface.

The method may also further include filtering out fluctuations in time and/or in magnitude of the return mud flow, if the fluctuations are below predetermined respective thresholds or extracting trends in the evolution of the input mud flow pumped into the well and in the evolution of the return mud flow.

The disclosed exemplary embodiments provide apparatuses and methods for an offshore installation in which the evolution of the input mud flow is compared to the evolution of the return mud flow inferred from qualitative indications to identify kick events. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An apparatus useable in an offshore drilling installation having a mud loop into a well drilled below a seabed, the apparatus comprising:

a blowout preventer coupled to a wellhead disposed on the seabed, the blowout preventer located near the seabed;

a riser coupled to the blowout preventer, the riser including a casing circumscribing a drill string to define an annular space therebetween;

a first sensor connected to a fluid pump, the fluid pump disposed at a surface location and configured to pump an input mud flow into the well to thereby circulate a drilling mud, the first sensor configured to measure the input mud flow pumped into the well;

a second sensor disposed near the seabed and configured to provide measurements indicating a variation of a return mud flow emerging from the well, the return mud flow flowing from the well towards the surface location via the annular space defined between the casing of the riser and the drill string; and a controller in communication with to the first sensor and to the second sensor and configured to perform the following to identify a likely occurrence of an ongoing or imminent kick event, to include:

monitoring and comparing an evolution of the input mud flow based on measurements received from the first sensor, and an evolution of the return mud flow based on measurements received from the second sensor, and identifying the likely occurrence of an ongoing or imminent kick event when:

the variation of the return mud flow increases while the input mud flow pumped into the well is substantially constant, or the variation of the return mud flow remains substantially constant or increases while the input mud flow pumped into the well decreases.

2. The apparatus of claim 1, wherein the identifying the likely occurrence of an ongoing or imminent kick event includes taking into consideration a delay between:

a normal increase or decrease of the input mud flow pumped into the well as measured by the first sensor, and an expected variation of the return mud flow, caused by the normal increase or decrease in the input mud flow pumped into the well; and wherein the controller is further configured to:

determine the expected variation of the return mud flow, determine the delay between the normal increase or decrease of the input mud flow pumped into the well as measured by the first sensor, and the expected variation of the return mud flow as measured by the second sensor, caused by the normal increase or decrease in the input mud flow pumped into the well, and generate an alarm signal upon identifying the likely occurrence of an ongoing or imminent kick event.

3. The apparatus of claim 1, wherein the blowout preventer comprises one or more blowout preventer units configured to be in an open state during normal drilling operations and to be switched to a closed state to interrupt the return mud flow through the riser; and wherein the controller is further configured:

to control the one or more blowout preventer units to be in the open state during the normal drilling operations, and to switch one or more of the one or more blowout preventer units into the closed state in response to identifying the likely occurrence of an ongoing or imminent kick event to thereby interrupt a fluid flowing therethrough, the fluid comprising the return mud flow.

4. The apparatus of claim 3, wherein the controller comprises one or both blowout preventer control pods.

5. The apparatus of claim 4 further comprising, one or more electrical or both electrical and hydraulic lines extending between the blowout preventer and a surface platform, defining an umbilical, the umbilical configured to provide for transporting signals between the one or both blowout preventer control pods and an operator interface on the surface platform; and wherein the one or both blowout preventer control pods is or are further configured to:

receive measurements from the first and the second sensors, and transmit one or both of the following to the operator interface:

the measurements received from the first and the second sensors, and measurements related to monitoring the input mud flow and the return mud flow to provide for visualization of the evolution of the input mud flow, the return mud flow, or both the input mud flow and the return mud flow.

6. The apparatus of claim 4, wherein the one or both blowout preventer control pods is further configured:

to generate an alarm signal indicating the likely occurrence of an ongoing or imminent kick event;

to transmit the alarm signal to the operator interface, the alarm signal indicating the likely occurrence of an ongoing or imminent kick event;

to trigger closing of the one or more blowout preventer units; and to transmit information related to the current state of the one or more blowout preventer units to the operator interface.

7. The apparatus of claim 6, wherein the one or more blowout preventer control pods is or are further configured to identify the likely occurrence of an ongoing or imminent kick event when either:

the variation of the return mud flow increases while the input mud flow pumped into the well is substantially constant; or the variation of the return mud flow remains substantially constant or increases while the input mud flow pumped into the well decreases.

8. The apparatus of claim 7, wherein the variation of the return mud flow is a derivative of a measurement of the return mud flow.

9. The apparatus of claim 6, wherein the second sensor comprises a flow measuring device located at a detection site sufficiently near the wellhead to provide for early detection of the likely occurrence of an ongoing or imminent kick event, the detection site for the second sensor located both:

adjacent to the wellhead to measure characteristics of the return mud flow when emerging from the wellhead to thereby provide the measurements indicating a variation of the return mud flow emerging from the well, and adjacent to the one or more blowout preventer control pods to connect thereto.

10. The apparatus of claim 1, wherein the second sensor comprises a flow measuring device positioned to receive the return mud flow emerging from the wellhead, and to provide flow-related measurements thereof.

11. The apparatus of claim 1, wherein the second sensor comprises one or more of the following:

a pressure sensor;

an electromagnetic sensor monitoring impedance of the return mud flow;

an acoustic sensor monitoring acoustic impedance of the return mud flow; and an ultrasonic sensor measuring the velocity of the return mud flow.

12. The apparatus of claim 1, wherein the second sensor comprises a combination of sensors combined to provide a reliable basis for estimating the return mud flow, neither sensor of the combination of sensors forming the second sensor individually providing a reliable basis for estimating the return mud flow.

13. The apparatus of claim 6, wherein the one or more blowout preventer control pods is or are further configured to:

determining trends in the evolution of the input mud flow pumped into the well, and determining trends in the evolution of the return mud flow to identify whether the rate of the return mud flow is changing greater than the respective predetermined threshold.

14. The apparatus of claim 6, further comprising:

a third sensor connected to the one or more blowout preventer control pods and configured to provide measurements related to ongoing drilling; and wherein the one or more blowout preventer control pods is or are further configured to confirm existence of the likely occurrence of an ongoing kick event based on the measurements of the third sensor before generating the alarm signal.

15. The apparatus of claim 14, wherein the third sensor is configured to provide for detecting a density change in the return mud flow.

16. The apparatus of claim 14, wherein the measurements provided by the third sensor are not flow measurements, the third sensor utilizing a different measurement principle than that of the second sensor.

17. A method of manufacturing an offshore drilling installation, the method comprising:

coupling a riser, a lower marine riser package and a blowout preventer to a wellhead of a well, the well drilled below a seabed beneath a water surface, the blowout preventer comprising one or more blowout preventer units forming a stack, each blowout preventer unit being configured to be in an open state during normal drilling operations and to be switched to a closed state to interrupt a fluid flowing therethrough;

providing a drill string extending through a casing of the riser such that an annular space between the casing of the riser and the drill string;

providing a first sensor configured to measure an input mud flow pumped into the well, and a second sensor configured to measure a variation of a return mud flow emerging from the well and entering the annular space between the casing of the riser and the drill string to complete a mud loop, the first sensor connected to a fluid pump disposed at a surface location, the fluid pump configured to pump the input mud flow into the well to thereby circulate a drilling mud, and the second sensor comprising a flow measuring device disposed near the seabed at a detection site sufficiently near the wellhead to provide for early detection of a likely occurrence of an ongoing or imminent kick event, the detection site for the second sensor being located both:

adjacent to the wellhead to measure characteristics of the return mud flow emerging from the wellhead and entering the annular space between the casing of the riser and the drill string en route to the surface location, and adjacent to a controller to connect thereto, the controller comprising one or more blowout preventer control pods located near the seabed and connected to a portion or portions of the blowout preventer; and connecting the first sensor and the second sensor to the one or more blowout preventer control pods, each of the one or more blowout preventer control pods being configured to perform the following steps to identify the likely occurrence of an ongoing or imminent kick event, to include:

receiving measurements from the first sensor, receiving measurements from the second sensor, monitoring comparatively an evolution of the input mud flow based on the measurements received from the first sensor, and an evolution of the return mud flow as inferred based on measurements received from the second sensor defining an inferred evolution of the return mud flow, and identifying the likely occurrence of an ongoing or imminent kick event responsive to the monitoring and comparing, the likely occurrence of an ongoing or imminent kick event identified when either:

a variation of the inferred evolution of the return mud flow increases while the evolution of the input mud flow pumped into the well is substantially constant, or the variation of the inferred evolution of the return mud flow remains substantially constant or increases while the evolution of the input mud flow pumped into the well decreases, while taking into consideration a delay between:

a normal increase or decrease of the evolution of the input mud flow pumped into the well as measured by the first sensor, and an expected variation of the evolution of the return mud flow, caused by the normal increase or decrease in the evolution of the input mud flow pumped into the well.

18. The method of claim 14, further comprising:

connecting the one or more blowout preventer control pods to the blowout preventer of the installation; and performing the following by the one or more blowout preventer control pods:

controlling the one or more blowout preventer units to be in an open state during the normal drilling operations, generating an alarm signal indicating the likely occurrence of an ongoing or imminent kick event, transmitting the alarm signal to an operator interface located on a surface platform at the surface, the alarm signal indicating the likely occurrence of an ongoing or imminent kick event, triggering closing of the one or more blowout preventer units, and transmitting information related to the current state of the one or more blowout preventer units to the operator interface.

19. The method of claim 17, wherein the controller is further configured to:

determine the delay between the normal increase or decrease of the evolution of the input mud flow pumped into the well as measured by the first sensor, and the expected variation of the return mud flow as measured by the second sensor, caused by the normal increase or decrease in the evolution of the input mud flow pumped into the well; and determine the expected variation of the return mud flow.

20. The method of claim 17, wherein the variation of the return mud flow is a derivative of a measurement of the return mud flow.

21. The method of claim 17, further comprising:

connecting one or more electrical or both electrical and hydraulic lines between the blowout preventer and a surface platform, defining an umbilical;

operably coupling the umbilical to both the one or more blowout preventer control pods and to an operator interface located on the surface platform; and transmitting one or more of the following to the operator interface via the umbilical:

measurements received from the first sensor and from the second sensor by the one or more blowout preventer control pods, and measurements related to monitoring the input mud flow and the return mud flow to provide for visualization of the evolution of the input mud flow, the return mud flow, or both the input mud flow and the return mud flow.

22. The method of claim 17, wherein the one or more blowout preventer control pods is or are configured to perform at least one of filtering out fluctuations in time and in magnitude of the return mud flow, if the fluctuations are below predetermined respective thresholds;

determining trends in the evolution of the input mud flow pumped into the well; and determining trends in the evolution of the return mud flow to identify whether the rate of the return mud flow is changing greater than the respective predetermined threshold.

23. The method of claim 17, further comprising:

connecting a third sensor to the one or more blowout preventer control pods, the third sensor configured to provide measurements related to the drilling, wherein the one or more blowout preventer control pods is or are further configured to confirm the likely occurrence of an ongoing or imminent kick event based on the measurements received from the third sensor, before generating an alarm signal.

24. A method of identifying an ongoing or imminent kick event in an offshore drilling installation having a wellhead disposed on a seabed disposed beneath a water surface, and a mud loop into a well drilled below the seabed, the method comprising:

connecting a blowout preventer and riser assembly to the wellhead, wherein the blowout preventer and riser assembly includes a riser casing circumscribing a drill string to define an annular space therebetween, the blowout preventer comprising one or more blowout preventer units forming a stack, each blowout preventer unit being configured to be in an open state during normal drilling operations and to be switched to a closed state to interrupt a fluid flowing therethrough;

connecting one or more electrical or both electrical and hydraulic lines between the blowout preventer and a surface platform, defining an umbilical;

operably coupling the umbilical to both an operator interface disposed on the surface platform and one or more blowout preventer control pods connected to a portion or portions of the blowout preventer to provide for communicating therebetween;

receiving measurements from a first sensor configured to provide measurements indicating an input mud flow pumped into the well the first sensor connected to a fluid pump disposed at a surface location on the surface platform, the fluid pump configured to pump the input mud flow into the well to thereby circulate a drilling mud;

receiving measurements from a second sensor configured to provide measurements indicating a variation of a return mud flow emerging from the well near the seabed and entering the annular space defined between the riser casing and the drill string, wherein the variation of the return mud flow is a derivative of a measurement of the return mud flow, the second sensor comprising a flow measuring device disposed near the seabed at a detection site sufficiently near the wellhead to provide for early detection of a likely occurrence of an ongoing or imminent kick event, the detection site for the second sensor being located both:

adjacent to the wellhead to measure characteristics of the return mud flow emerging from the wellhead and entering the annular space between the casing of the riser and the drill string en route to the surface location, and adjacent to a controller to connect thereto at a distance sufficient to prevent substantial travel time delays, the controller comprising one or more blowout preventer control pods located near the seabed and connected to a portion of the blowout preventer;

based on the received measurements, monitoring and comparing an evolution of the input mud flow and an inferred evolution of for the return mud flow; and identifying existence of the likely occurrence of an ongoing or imminent kick event responsive to the monitoring and comparing:

when the derivative of the measurement of the return mud flow increases while the input mud flow pumped into the well is substantially constant, or when the derivative of the measurement of the return mud flow remains substantially constant or increases while the input mud flow pumped into the well decreases, while taking into consideration a delay between:

a normal increase or decrease of the input mud flow pumped into the well, and the variation of the return mud flow caused by the normal increase or decrease of the input mud flow pumped into the well.

25. The method of claim 24, further comprising the following performed by the one or more blowout preventer control pods:

generating an alarm signal upon identifying the likely occurrence of an ongoing or imminent kick event;

triggering closing of the one or more blowout preventer units;

transmitting the measurements received from the first sensor and from the second sensor to an operator interface located at the surface; and transmitting information related to the current state of the one or more blowout preventer units to the operator interface.

26. The method of claim 24, further comprising at least one of:

configuring the second sensor to provide measurements indicating a change in the rate of the return mud flow emerging from the well near the seabed;

filtering out fluctuations in time and in magnitude of the return mud flow, if the fluctuations are below predetermined respective thresholds;

determining trends in the evolution of the input mud flow pumped into the well; and determining trends in the evolution of the return mud flow.

27. The method of claim 24, further comprising confirming existence of the likely occurrence of an occurrence of ongoing or imminent kick event based on measurements received from a third sensor.

* * * * *